US012295432B2

(12) United States Patent
Lewis

(10) Patent No.: US 12,295,432 B2
(45) **Date of Patent: *May 13, 2025**

(54) SANITIZING FACE MASK

(71) Applicant: Randall J. Lewis, Bethesda, MD (US)

(72) Inventor: Randall J. Lewis, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/352,778

(22) Filed: Jun. 21, 2021

(65) Prior Publication Data

US 2022/0175066 A1 Jun. 9, 2022

Related U.S. Application Data

(62) Division of application No. 17/115,253, filed on Dec. 8, 2020, now Pat. No. 11,083,231.

(51) Int. Cl.

| | |
|---|---|
| ***A41D 13/11*** | (2006.01) |
| *A41D 31/12* | (2019.01) |
| *A42B 3/22* | (2006.01) |

(52) U.S. Cl.

CPC ..... *A41D 13/1192* (2013.01); *A41D 13/1107* (2013.01); *A41D 13/1176* (2013.01); *A41D 13/11* (2013.01); *A41D 13/1123* (2013.01); *A41D 13/1161* (2013.01); *A41D 31/125* (2019.02); *A41D 2500/30* (2013.01); *A42B 3/22* (2013.01); *A42B 3/225* (2013.01)

(58) Field of Classification Search

CPC ..... A41D 13/1192; A41D 13/1107; A41D 13/1176; A41D 13/11; A41D 13/1161; A41D 13/1123; A41D 31/125; A41D 2500/30; A42B 3/22; A42B 3/225

USPC ..... 2/9; 128/206.19

See application file for complete search history.

(56) References Cited

U.S. PATENT DOCUMENTS

| | | | |
|---|---|---|---|
| 4,790,307 | A | 12/1988 | Haber |
| 7,077,137 | B2 | 7/2006 | Russell |
| 7,077,139 | B2 | 7/2006 | Amante |
| 7,559,968 | B2 | 7/2009 | Bolduc |
| 7,845,351 | B2 | 12/2010 | Mathis et al. |
| 7,879,746 | B2 | 2/2011 | Klun et al. |
| 9,616,258 | B2 | 4/2017 | Tsuei |
| 10,010,496 | B2 | 7/2018 | Cozean |

(Continued)

OTHER PUBLICATIONS

Bruno J. Strasser, Thomas Schlich—Geneva Switzerland—The LANCET.com—Title—The Art of Medicine—A History of the Medical Mask and the Rise of Throwaway Culture—vol. 396—Jul. 4, 2020—found at: https://doi.org/10.1016/S0140-6736(20)31207-1.

(Continued)

*Primary Examiner* — Khaled Annis
*Assistant Examiner* — Dakota Marin
(74) *Attorney, Agent, or Firm* — Ernest D. Buff & Associates, LLC; Ernest D. Buff

(57) ABSTRACT

A sanitizing face mask inhibits the transmission of pathogens in air respired through the nose and mouth of a wearer. The mask includes hydrophobic inner and outer layers and an intermediate layer enclosed between them. The intermediate layer is saturated with a sanitizing liquid such as an ethanol solution. Respired air encounters the sanitizing liquid as it passes through the intermediate layer, killing pathogens borne on droplets or aerosols. The sanitizing mask protects the wearer, from pathogens in the inspired air, and others, from possible pathogens in the expired air of the wearer.

12 Claims, 2 Drawing Sheets

(56) References Cited

U.S. PATENT DOCUMENTS

| | | | | |
|---|---|---|---|---|
| 10,201,198 | B2 | 2/2019 | Tong et al. | |
| 10,486,001 | B1 | 11/2019 | Bailey | |
| 10,500,316 | B2 | 12/2019 | Bontigao | |
| 10,660,385 | B2 * | 5/2020 | Nagao | A41D 13/1161 |
| 10,744,351 | B2 * | 8/2020 | Fujimori | A41D 13/1161 |
| 2003/0047186 | A1 * | 3/2003 | Dyer | A61K 36/00 128/203.29 |
| 2004/0000313 | A1 | 1/2004 | Gaynor | |
| 2005/0133036 | A1 * | 6/2005 | Steindorf | A41D 13/11 128/206.13 |
| 2005/0172968 | A1 * | 8/2005 | Hishida | A62B 23/025 128/205.25 |
| 2010/0018533 | A1 * | 1/2010 | Biedermann | D06M 13/192 128/206.19 |
| 2010/0330140 | A1 * | 12/2010 | Stewart | A41D 13/11 424/641 |
| 2014/0224261 | A1 | 8/2014 | Tsuei | |
| 2017/0189284 | A1 | 7/2017 | Lo | |

OTHER PUBLICATIONS

Thomasnet.com—How Surgical Masks are Made, Tested and Used—Nov. 12, 2020—found at: https://Thomasnet.com/articles/other/how-surgicalmasks are made, tested and used.

* cited by examiner

SANITIZING FACE MASK

CROSS-REFERENCE TO RELATED APPLICATIONS

This application is a divisional of applicant's co-pending U.S. patent application Ser. No. 17/115,253, filed Dec. 8, 2020, entitled "SANITIZING FACE MASK", the disclosure of which is hereby incorporated in its entirety by reference thereto.

1. FIELD OF THE INVENTION

The present invention relates to a face mask; and, more particularly, to a sanitizing face mask configured to include a layer moistened by a liquid antimicrobial agent that kills pathogens contained in air being respired by a mask wearer.

2. TECHNICAL BACKGROUND

More than a century ago, the use of cloth face masks began in medical practice to control infection. Based on scientific research that linked bacteria to infections commonly incurred in hospitals and that demonstrated the presence of bacteria in respiratory droplets, practitioners recognized the potential for masks worn over the nose and mouth to improve care by reducing the spread of the microbes. Mask wearing soon became ubiquitous in medical practice. Spurred by the Spanish flu pandemic in the early twentieth century, mask usage also became known for the general public outside the specific context of medical practice. The recent spread of the coronavirus disease commonly termed "COVID-19," has intensified interest in the value of face masks for both the medical community and the general public.

Numerous prior art disclosures relate to face masks appointed to be worn in a position covering the nose and mouth of a wearer for medical reasons. Many such masks are constructed with one or more layers of a woven or non-woven, fabric-like material or a fibrous, paper-like material. The mask is intended to inhibit the passage of pathogens into or out of the nose and mouth of the wearer during ordinary respiration. Pathogens or microbes of concern include bacteria and bacterial spores, viruses, and fungi; they can cause serious infections and even fatalities in humans. Although pathogens can be present in ambient air as isolated entities, they are commonly borne on larger liquid or solid particles. It is generally believed that transmission via such droplets or particles is far more prevalent as a mechanism for spreading disease than the presence of isolated microbes. Fortunately, the larger size of particles or droplets makes it easier for them to be mechanically collected on fibers that form a mask. If properly placed on a wearer's face, a mask creates a physical barrier that reduces transmission of fluid droplets or other particles that may bear pathogens. Thus, masks are likely to reduce the spread of disease.

Early face masks commonly employed one or more layers of cotton or woolen gauze, which could be washed and sterilized for reuse. Disposable masks using paper filtration elements have also been used. By the 1960s, various forms of non-woven, synthetic fiber textiles began to supplant paper or natural-fiber gauze. Face masks now commercially available may have a multilayer structure in which one or more of the layers is a filtration layer, which may be made of a non-woven material. The inner and outer layers also may be non-woven. The type, size, and density of fibers in the filtration layers are selected to provide passages that trap droplets larger than a preselected size, which is typically of the order of 1 μm, while leaving sufficient porosity to not result in an excessive pressure drop that would impede the wearer's respiration.

However, the droplets present in normal breathing as well as those expulsed by coughing or sneezing, can exist in a wide variety of sizes. Practical design of both face masks and respirators must strike a balance between filtration efficiency and the need to maintain impedance to air flow that is low enough that a wearer's breathing is not unduly impaired.

U.S. Pat. No. 4,790,307 to Haber discloses a mask that includes a containment envelope in which a rupturable membrane containing an anti-bacterial fluid (such as Betadine) is sealed in a containment envelope. To activate the mask, a user breaks the membrane to release the fluid, which is said to be evenly distributed into fluid absorbent fibrous pads sandwiching the membrane. The containment envelope includes apertures through which the user must breathe. However, the airflow necessarily can pass only through the apertures, and not through other portions of the containment envelope, which are air-impermeable.

Face masks (sometimes also called surgical masks) are generally distinguished from respirators. The latter are constructed so as to seal as tightly against a wearer's face as possible, so that the largest possible fraction, and preferably all, of the respired air passes through the respirator body or filtration element. Respirators are constructed with either (a) material that can be readily molded to the shape of the wearer's face or (b) with a compliant, elastomeric edge that seals against the wearer's face when secured in position. Face masks ordinarily have a looser fit, so that some of the wearer's respired air may pass through gaps between the mask and the face. Face masks that attain a sufficient degree of filtration of the air passing through them are sometimes termed "surgical masks" in accordance with certain standards promulgated by governmental or regulatory agencies.

Notwithstanding the known improvements in surgical masks, including those discussed above, there remains a need in the art for masks that are inexpensive to manufacture and thus disposable, and convenient and comfortable to wear, while providing improved protection to inhibit the spread of disease.

SUMMARY OF THE INVENTION

The present invention provides in various aspects a sanitizing face mask for inhibiting the transmission of pathogens in air respired through the nose and mouth of a wearer and methods for the construction and use thereof. The mask includes an intermediate layer saturated with a sanitizing liquid capable of killing pathogens contained in the air passing through the mask.

In one aspect, the mask has top and bottom edges and two side edges, and comprises a mask body and securing ties that are attached thereto. The securing ties are configured to secure the mask with the mask body disposed across the nose and mouth of the wearer. The mask body comprises an inner layer, an outer layer, and an intermediate layer having absorbed therein a sanitizing liquid, wherein:

a) the inner layer is permanently attached to the outer layer on at least one of the edges;
b) the inner layer is adhered to the outer layer on the remaining edges to form a cavity; and
c) the intermediate layer is enclosed in the cavity between the inner and outer layers.

Another aspect provides a kit for assembling a sanitizing face mask for inhibiting the transmission of pathogens in air respired through the nose and mouth of a wearer. The mask has top and bottom edges and two side edges. The kit comprises a mask preform and an intermediate layer; the mask preform comprises an inner layer, an outer layer, and securing ties. wherein:

a) the inner layer is permanently attached to the outer layer on at least one of the edges;
b) the inner layer is configured to be adhered to the outer layer on the remaining edges to form a cavity;
c) the intermediate layer is configured to be saturated with a sanitizing liquid and thereafter situated in the cavity between the inner and outer layers and enclosed therein to form a mask body; and
d) the securing ties are configured to secure the mask with the mask body disposed across the nose and mouth of the wearer.

In some embodiments, the kit further includes a container of a suitable sanitizing liquid that is appointed to be dispersed in the absorbent intermediate layer before the layer is situated within the mask preform and enclosed therein.

Still another aspect provides a method for inhibiting the transmission of pathogens in air respired through the nose and mouth of a wearer. Generally stated, the method comprises:

a) providing a mask preform comprising an inner layer and an outer layer having top and bottom edges and two side edges, and securing ties, and wherein: (i) the inner layer is permanently attached to the outer layer on at least one of the edges; (ii) the inner layer is configured to be adhered to the outer layer on the remaining edges to form a cavity; and (iii) the securing ties are configured to secure the mask across the nose and mouth of the wearer;
b) providing an intermediate layer configured to be saturated with a sanitizing liquid and thereafter situated in the cavity between the inner and outer layers;
c) saturating the intermediate layer with a sanitizing liquid;
d) situating the saturated intermediate layer within the mask preform;
e) adhering the inner layer to the outer layer on the remaining edges, whereby the intermediate layer is enclosed in the cavity to form a mask body and the mask is prepared for use by the wearer.

In certain aspects, a preponderance of the air respired by the wearer during mask use passes through the intermediate layer, and the mask body is configured to be free of any areas within the cavity that are impermeable to air flow.

While previous masks mechanically filter air though dry material, the sanitizing liquid in the intermediate layer of the subject mask sterilizes both the air inhaled by the wearer and the air exhaled by the wearer. Accordingly, the sanitizing mask (i) protects the wearer from microbes in the inspired air and (ii) protects others by destroying any microbes that might be expired by an infected wearer, whether or not the wearer has any symptoms.

BRIEF DESCRIPTION OF THE DRAWING

The invention will be more fully understood and further advantages will become apparent when reference is made to the following detailed description of certain preferred embodiments of the invention and the accompanying drawings, wherein like reference numerals denote similar elements throughout the several views and in which.

DETAILED DESCRIPTION

Various aspects of the present disclosure relate to the construction and use of sanitizing face masks that include an intermediate fluid absorbent layer in which a sanitizing liquid is dispersed. The sanitizing liquid provides an additional mechanism of operation that is not present or operative in masks that lack inherent antimicrobial activity and instead rely only on mechanical filtering. The additional mechanism enhances the ability of the masks to reduce the transmission of airborne pathogens attendant to human respiration. The mask ameliorates air passing through it, both by mechanically trapping at least some of airborne droplets and aerosols and by killing microbes by exposing them to the sanitizing liquid and/or vapor arising from it.

As set forth herein, the terms inner, outer, and intermediate are used with respect to the sequential layers of a mask and refer to their ordering in the mask as positioned and customarily worn by a user, with the inner layer closest to the wearer's face and the outer layer exposed to the outside world. Directional terms, such as top, bottom, side, and corner are used in their ordinary sense with respect to the mask as it would be situated normally on the wearer.

Figure 1:
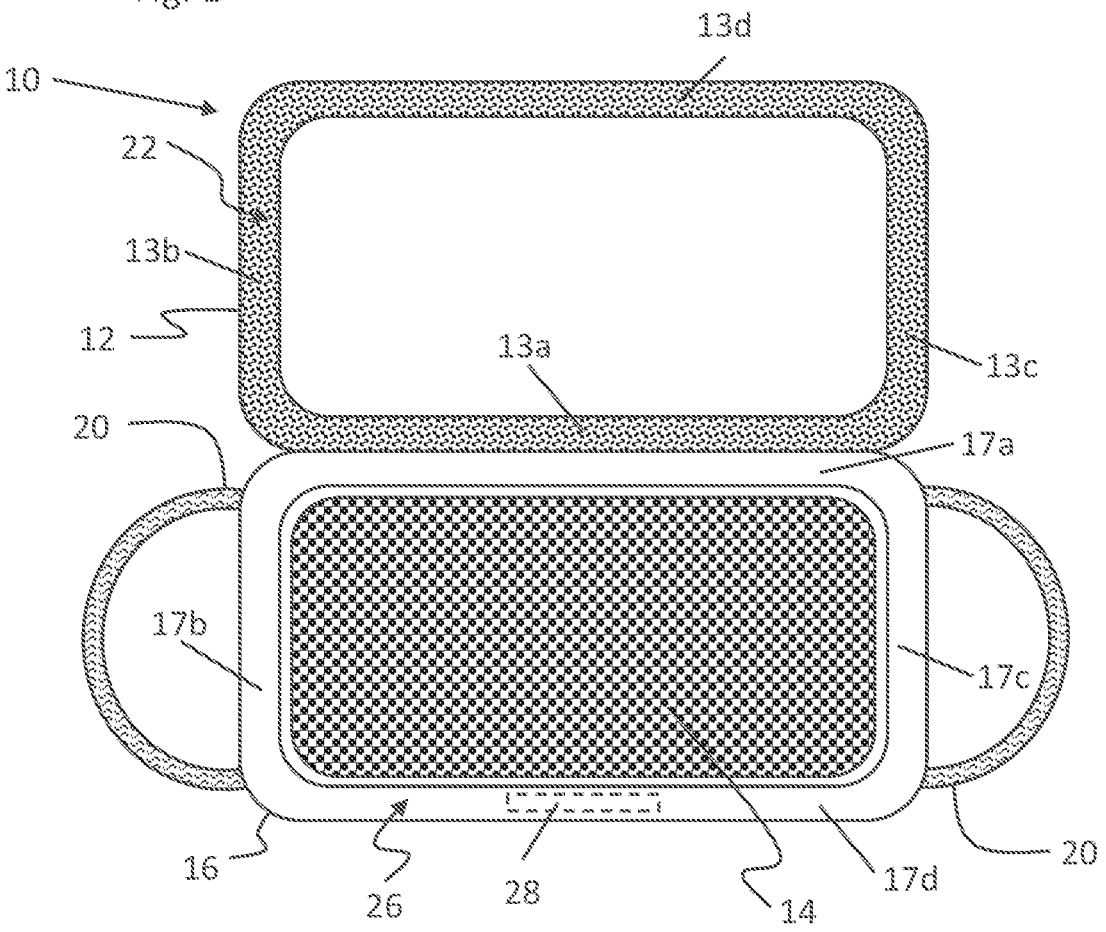
FIG. 1 depicts in rear plan view a sanitizing face mask of the present disclosure before its final assembly.
Figure 2:
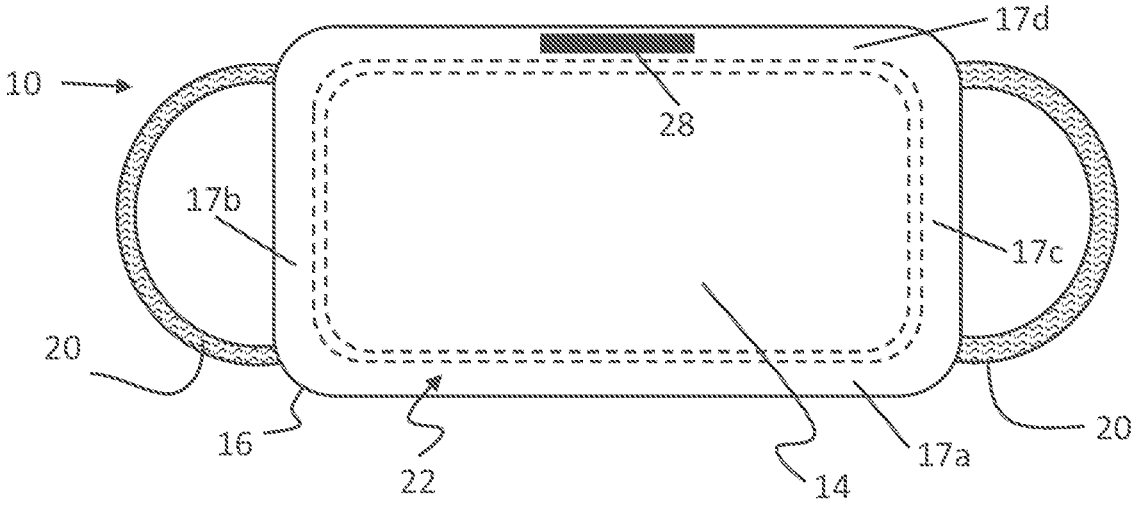
FIG. 2 depicts in front plan view a sanitizing face mask of the present disclosure after its final assembly.

FIGS. 1 and 2 depict generally at 10 an implementation of the present sanitizing face mask. This embodiment employs a unitary construction in which inner layer 12 and outer layer 16 are constructed with a single sheet of starting material. FIG. 1 depicts the configuration before the mask 10 is fully assembled. The starting material is appointed to be folded over itself in half along a fold line. The folding defines inner layer 12 and outer layer 16, which are permanently attached along corresponding bottom edges 13*a* and 17*a*. In this embodiment, edges 13*a* and 17*a* are inherently defined by the fold line. Inner layer 12 further includes side edges 13*b*, 13*c*, and top edge 13*d*, while outer layer 16 further includes corresponding side edges 17*b*, 17*c*, and top edge 17*d*. A stripe of pressure sensitive adhesive material 22 is deposited around the entire periphery of the inner side of inner layer 12. Optionally, the stripe is initially covered with a protective release layer that is appointed to be removed prior to the completion of the sealing operation.

To ready mask 10 for use, intermediate layer 14 is prepared by applying a sanitizing liquid that is absorbed and/or dispersed through it by ordinary capillary action. Intermediate layer 14, along with its sanitizing liquid, is situated within the frame defined by adhesive 22. The user would thereafter press the mating surfaces of adhesive 22 and peripheral frame area 26 together to adhere the layers to complete the seal around the entire periphery and thereby enclose the intermediate layer and its sanitizing liquid. Of course, the adhesive could alternatively be applied on the periphery of outer layer 16 or of both inner and outer layers. In an implementation, the seal provided by adhesive 22 is substantially airtight. Together, inner layer 12, outer layer 16, and saturated intermediate layer 14 enclosed therein form the mask body. Ordinarily, the mask body, and its inner and outer layers, have a generally rectangular external shape, possibly with rounded corners as shown. However, the shape may be deviated from precise rectangularity to better accommodate and conform to the three-dimensional shape of the face of a normal human wearer.

In an alternative construction, the intermediate layer is bonded or otherwise attached to either the inner or outer layer during initial assembly, but before the sanitizing liquid is introduced.

Mask 10 further includes securing ties that permit mask 10 to be secured on a user's face in a position such that it generally covers the nose and mouth. In the embodiment depicted, the ties are in the form of two elastic cord loops 20 that are attached to the top and bottom of outer layer 16 at respective side edges 17*b*, 17*c*. Loops 20 have a length selected to allow them to be fitted around and behind the wearer's ears, with a slight tension that urges the mask into suitable contact with the wearer's face. Mask 10 also includes nose clamp 28, which is attached in a generally central location on top edge 17*d* of outer layer 16.

FIG. 2 depicts in front view the mask 10 of FIG. 1 after it has been assembled with intermediate layer 14 placed between inner and outer layers 12, 16.

In an alternative implementation, inner layer 12 and outer layer 16 are initially fabricated as separate pieces but are subsequently permanently attached on their respective bottom edges 13*a* and 17*a*. For example, the layers could be formed from two pieces of material that are attached by solvent, thermal or ultrasonic welding; stitching; stapling; gluing; or other like technique that would secure them together permanently. Layers 12 and 16 would configured to be adhered later, e.g. by the end user, along their side edges 13*b*, 13*c* and 17*b*, 17*c* and their top edge 13*d* and 17*d* after placement of saturated intermediate layer 14 between them. The attachment might be made with pressure-sensitive adhesive 22, 24 suitably disposed in stripes along the side and top edges. Alternatively, the edges could be closed with other closure forms, such as a hook-and-loop fastener system of the type commonly known as VELCRO™, a zipper, snaps, ties, or other types of closure. Preferably, the closure of the mask encasing the intermediate layer is airtight, so as not to create an alternative path for respired air that does not pass through all three layers.

In still another alternative, inner and outer layers 12, 16 might initially be joined on three of their edges to form a pocket open only at top edges 13*d*, 17*d*. This pocket would be appointed to receive saturated intermediate layer 14. This implementation might employ pressure-sensitive adhesive stripes on just the opposing top edges to close mask 10 after the intermediate layer 14 is placed; any of the other closure forms mentioned above could alternatively be used. Mask 10 could then be prepared for use by inserting intermediate layer 14 and its sanitizing liquid into this pocket and sealing the top edges.

The closure and sealing of the edges of the inner and outer layers of the mask defines an active area of the mask body, i.e. the area within the surrounding rim of each layer in which the sealing is effected, through which respired air can flow. Ordinarily, the inside and outside layers are of approximately equal size. In various embodiments, the active area of the mask body is at least 65%, preferably 75% and most preferably 80% of the total area of each of inner and outer layers 12, 16.

Figure 3:
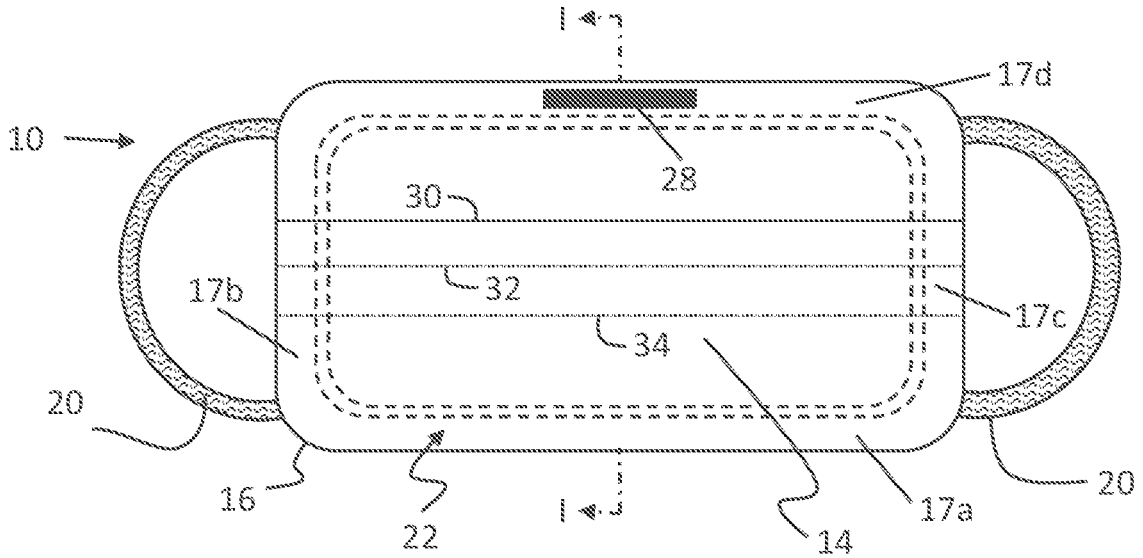
FIG. 3 depicts in front plan view a sanitizing face mask of the present disclosure having a pleated structure after its final assembly.
Figure 4:
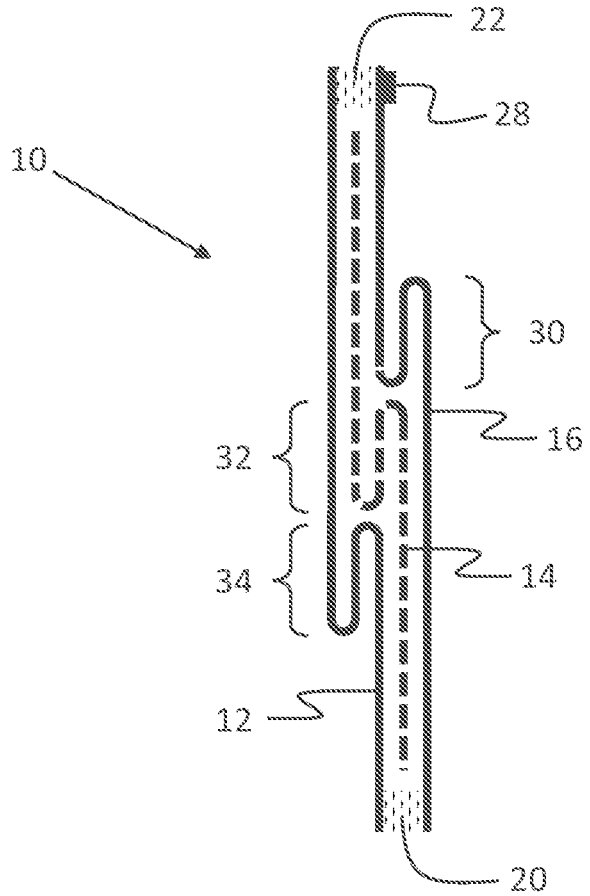
FIG. 4 depicts the sanitizing face mask of FIG. 3 in a side cross-sectional view taken at I-I.

To provide a mask configuration that better conforms to the typical three-dimensional shape of a human face, pleats are sometimes included, such as the horizontally-directed pleats depicted in in the front view of FIG. 3 and the cross-sectional view of FIG. 4, which is taken at I-I shown in FIG. 3. As best seen in FIG. 4, pleats 32, 34, and 36 are formed in inner layer 12, intermediate layer 14, and outer layer 16, respectively. When donning the mask, a user can spread the mask by pulling on the top and bottom edges to enlarge the central area of the mask and create a more cup-like or cone-like geometry that better conforms to a user's face. In embodiments in which the inner and outer layers are pleated, the active area is understood to be the area with the pleats expanded.

In an implementation, intermediate layer 14 is sized to occupy as much as possible of the area of the cavity created between inner layer 12 and outer layer 16 in any of the foregoing configurations of the mask body. Layer 14 thereby has an effective area through which airflow can occur that is substantially equal to the active area of the mask body. As a result, substantially all the air passing through the mask also passes through intermediate layer 14, so that it encounters the sanitizing liquid maximally to improve the likelihood that airborne pathogens are killed. The present mask thus differs from the mask of the Haber '307 patent discussed above, in that the component layers are all uniformly permeable for air flow. By contrast, the containment envelope employed by Haber for anti-bacterial fluid is necessarily impermeable to the flow of both liquid and air to carry out its containment function. Even after the envelope is ruptured to release its fluid, it remains impermeable everywhere except for certain limited areas in which apertures are provided. The impermeable area thus contributes extra impedance to air flow, making the user's breathing more difficult because of the limited passageways for respired air. In an embodiment, the present mask is substantially free of any areas of the mask body that are impermeable to air flow, other than that lost on the periphery to the attachment and sealing of the inner and outer layers to form the cavity and define its effective area. By "substantially free" is meant that none of the area within the cavity is occupied by impermeable material that is intentionally included in the construction.

Embodiments of the present mask in which layer 14 is smaller than the pocket are also contemplated. These beneficially reduce flow impedance, but less of the air transmitted would encounter the sanitizing liquid, which would be unacceptable for some applications. In various embodiments, the effective area of layer 14 ranges from about 75 to 99%, preferably about 90%, more preferably about 90 to 95% and most preferably about 92.5% of the active area of the mask body.

A wide variety of fibrous materials are useful for both the inner and outer layers of the present mask, and for the intermediate layer. The terms "fiber" and "fibrous" are used herein to refer to particulate matter wherein the length to diameter ratio of the particulate matter is greater than or equal to about 10, but fibers having even higher ratio are also contemplated. The fibers may be approximately circular in cross-section, but other cross-sectional geometries are also possible, as are fibers that have solid or hollow cross sections. The fibers may have a distribution of lengths and/or diameters. Both synthetic and natural fibers are contemplated, as further described below. Synthetic fibers may include any polymeric or copolymeric materials having the requisite mechanical and chemical properties. In some embodiments, elastomeric fibers may be included. Various materials useful in the present construction are disclosed by US 2012/0325843 to Tsuei et al., which disclosure is hereby incorporated in its entirety by reference thereto.

The fibers used in the present mask, particularly in the inner and outer layers, are typically in the form of a nonwoven web or fabric. As used herein, these terms refer to a web or fabric sheet that incorporate individual fibers which are interlaid, but not in a way that is regular or periodic, such as would be created by knitting or weaving operations. Known processes use to create nonwovens include melt blowing, spin bonding, hydroentangling, and bonding carded webs.

"Melt blown fibers" are fibers typically formed by extruding thermoplastic material through a die having a plurality of fine, usually circular capillary holes as molten filaments into a high velocity, hot gas stream that attenuates them to reduce their diameter. The gas stream propels the fibers onto a collecting surface on which a web of randomly dispersed fibers coalesces. The fibers may all be of the same composition and cross section. They may also differ in either or both composition, fiber length and cross section. The fibers may also have a core-sheath structure in which the composition varies across the cross section.

"Spin bonding" refers a process in which small diameter fibers are formed or "spun" by extruding a molten thermoplastic material through capillary holes (usually circular) in a spinneret as filaments whose diameter is then rapidly reduced. The fibers are then massed between heated rolls of a calender to form a thermally bonded web. The bonding may also be accomplished by other techniques known in the nonwoven art.

"Hydroentangling" pertains to a process in which high speed water jets are impinged on a web to cause entanglement and intermingling of the constituent fibers.

Materials useful for the construction of the inner and outer layers of the present mask in certain embodiments are ones that are hydrophobic. As used herein, the term "hydrophobic" is understood to refer to materials that do not absorb moisture and are not wetted by it. Materials can be rendered hydrophobic either by the bulk or surface composition of its constituent fibers or a surface coating.

Since the materials of the inner and outer layers are hydrophobic, they are not wetted by moisture in either inhaled or exhaled air or by the sanitizing liquid. As a result, such materials would present a relatively dry surface on the inside against the wearer's skin, and would mitigate any wetness on the outside after extended wear.

Exemplary materials useful in the present construction include non-woven fabrics comprising fibers of polymeric materials such as polypropylene, polystyrene, polycarbonate, polyethylene, or polyester that can be made with spin-bonding or melt-blowing techniques. Preferred materials are polypropylene fibers, including fibers of isotactic, syndiotactic, and atactic polypropylenes, and mixtures thereof. Alternatively, certain woven fabrics, including ones made with natural fibers or a blend of natural and synthetic fibers may be used. The same or different materials could be used for the inner and outer layers. Each of the layers of the present mask may be formed as a single layer of substantially uniform material. Alternatively, any of the layers might be constructed in multi-ply form or with multiple sublayers of the same or different materials. The sublayers could be bonded throughout their area or attached in more limited regions or even just at their edges.

While the inner and outer layers of the mask are preferably hydrophobic, some or all of the intermediate layer comprises a hydrophilic material. As used herein, "hydrophilic," "hydrophilicity," or similar terms are used to describe materials that can be wet by water, alcohols, or other polar liquids, or by aqueous solutions of salts, acids, or bases. Thus, the intermediate layer is capable of absorbing a sanitizing liquid. For example, the intermediate layer may include a material comprising cotton or wool fibers, possibly in the form of woven or non-woven fabrics, webs, or batts, while also being permeable to air. In some implementations, the intermediate layer comprises multiple sub-layers, of which at least one is made of an absorbent material. One such construction is taught by U.S. Pat. No. 7,879,746 to Klum et al., the disclosure of which is hereby incorporated in its entirety by reference thereto. The intermediate layer might also include hydrophilic fillers such as, for example, wood pulp, cellulose, cotton, rayon, recycled cellulose, and shredded cellulose sponge, and other known functional additives. The thickness and composition of the intermediate layer and any of its individual constituents can be adjusted to render it capable of absorbing a desired amount of the sanitizing liquid.

The present sanitizing face mask is ordinarily positioned and secured on the wearer's face by securing ties. The ties are usually made of a fabric or a woven cord, strip, band, ribbon, or the like, though any metallic or non-metallic wire, cable, or the like providing secure disposition of the mask on the wearer might also be used. Ordinarily, a tie is attached at each of the four corners of the mask. In one implementation as shown in FIGS. 1 and 2, the ties 20 are in the form of a continuous elastic cord loop on each side, with each respective loop extending continuously from the top corner to the bottom corner of the mask on the corresponding side, with a length selected to allow the loop to be fitted around and behind the wearer's ear, with a slight tension that urges the mask into suitable contact with the wearer's face. In another implementation, four individual ties depend from the four corners of the mask, with a length permitting the ties to encircle the wearer's head and be knotted at the back of the head. For example, the ties coming from the top and bottom corners of the mask on one side might be knotted with the corresponding ties coming from the top and bottom corners of the other side. Alternatively, a first elastic loop connecting the respective top corners and a second elastic loop connecting the bottom corners, and sized to encircle the back of the wearer's head, could be used. One or more additional ties might be added to provide a greater security and accuracy of placement of the mask. In still other implementations individual securing ties might terminate in known types of mating clips, hooks, or the like that are adapted to be reversibly engaged to secure the mask. Other suitable dispositions of the ties will be apparent to the skilled artisan and are contemplated herein. The ties may be attached to the mask by any suitable technique, including those suitable for joining the inner and outer mask layers. In still other embodiments, the securing ties may be provided by loops formed unitarily with the inner or outer layer.

The present mask may further include a nose clamp. In different embodiments, the nose clamp may be formed of a malleable, metallic or non-metallic wire or narrow strip that is attached in a generally central location at or near the top edge of the mask. For example, FIGS. 1 and 2 depict nose clamp 28 that is bonded on the external surface of outer layer 16, but it might alternatively be sandwiched between the various layers. In use, the nose clamp is bent into a shape such that the top edge of the mask is urged to conform to the shape of the user's nose and cheeks where the mask falls, thus minimizing the amount of respired air that passes out of the mask through any gap between the top edge of the mask and the wearer's face. Ordinarily, it is intended that the mask be positioned such that the nose clamp is situated across the bridge of the wearer's nose.

The sanitizing liquid used in the present mask may be any liquid that has sufficient biocidal activity to act on the pathogens of concern. In an embodiment, the liquid has a volatility that permits it to remain active and effective for a desired use time, while not affecting the mask wearer deleteriously. One such substance is ethanol or an aqueous solution of ethanol containing at least 50% alcohol by volume, or whatever increased proportion is required for effective biocidal activity. The ethanol could optionally be provided by virtually any alcoholic beverage having the requisite alcohol content. Solutions of other alcohols may also be used. Non-alcohol based solutions may contain benzalkonium chloride or triclosan. Still other examples of sanitizing fluids are provided in US2017/0326057 to Cozean et al., the disclosure of which is hereby incorporated by reference thereto.

Another aspect of the present disclosure provides a kit for assembling a sanitizing face mask as described above. The kit comprises a mask preform and an intermediate layer. The mask preform includes the inner and outer layers and the securing ties. The kit is assembled by first situating the intermediate layer within the preform, then closing the preform and sealing it on the open edges to define the cavity. Optionally, the kit is manufactured and furnished with the intermediate layer being bonded or otherwise attached to either the inner or outer layer during initial manufacture, in readiness for the introduction of the sanitizing liquid. The kit optionally includes a container having a requisite amount of the sanitizing liquid. At the point of use, the liquid is dispersed in the intermediate layer before it is placed in the mask preform. Alternatively, a suitable sanitizing liquid could be provided by other means.

Both the sanitizing mask itself and any kit should be provided clean, in a sealed, easily opened covering. Both can be provided sterile, although formal sterilization may not be specifically required.

Various materials are described herein as useful in constructing the present mask and for the sanitizing liquid. These are not limiting; it is contemplated that one of ordinary skill in the relevant arts could make minor substitutions of additional ingredients and not substantially change the desired properties and functioning of the mask, including its ability to filter and kill pathogens passing therethrough.

Where a range of numerical values is recited or established herein, the range includes the endpoints thereof and all the individual integers and fractions within the range, and also includes each of the narrower ranges therein formed by all the various possible combinations of those endpoints and internal integers and fractions to form subgroups of the larger group of values within the stated range to the same extent as if each of those narrower ranges was explicitly recited. Where a range of numerical values is stated herein as being greater than a stated value, the range is nevertheless finite and is bounded on its upper end by a value that is operable within the context of the invention as described herein. Where a range of numerical values is stated herein as being less than a stated value, the range is nevertheless bounded on its lower end by a non-zero value.

In this specification, unless explicitly stated otherwise or indicated to the contrary by the context of usage, where an embodiment of the subject matter hereof is stated or described as comprising, including, containing, having, being composed of, or being constituted by or of certain features or elements, one or more features or elements in addition to those explicitly stated or described may be present in the embodiment. An alternative embodiment of the subject matter hereof, however, may be stated or described as consisting essentially of certain features or elements, in which embodiment features or elements that would materially alter the principle of operation or the distinguishing characteristics of the embodiment are not present therein. A further alternative embodiment of the subject matter hereof may be stated or described as consisting of certain features or elements, in which embodiment, or in insubstantial variations thereof, only the features or elements specifically stated or described are present. Additionally, the term "comprising" is intended to include examples encompassed by the terms "consisting essentially of" and "consisting of." Similarly, the term "consisting essentially of" is intended to include examples encompassed by the term "consisting of."

In this specification, unless explicitly stated otherwise or indicated to the contrary by the context of usage, amounts, sizes, ranges, formulations, parameters, and other quantities and characteristics recited herein, particularly when modified by the term "about," may but need not be exact, and may also be approximate and/or larger or smaller (as desired) than stated, reflecting tolerances, conversion factors, rounding off, measurement error, and the like, as well as the inclusion within a stated value of those values outside it that have, within the context of this invention, functional and/or operable equivalence to the stated value.

Having thus described the invention in rather full detail, it will be understood that this detail need not be strictly adhered to but that further changes and modifications may suggest themselves to one skilled in the art, all falling within the scope of the invention as defined by the subjoined claims.

The invention claimed is:

1. A method for inhibiting the transmission of pathogens in air respired through the nose and mouth of a wearer, comprising:

a) providing a mask preform comprising an inner layer and an outer layer having top and bottom edges and two side edges, and securing ties, the inner layer and the outer layer having a unitary construction comprising a sheet of starting material folded over itself along a fold line, and wherein: (i) the inner layer is integral with the outer layer on at least one of the edges; (ii) the inner layer is configured to be adhered to the outer layer on the remaining edges to form a cavity; and (iii) the securing ties are configured to secure the mask across the nose and mouth of the wearer;

b) providing an intermediate layer configured to be saturated with a sanitizing liquid and thereafter enclosed in the cavity between the inner and outer layers;

c) saturating the intermediate layer with a sanitizing liquid comprising an aqueous solution of ethanol containing at least 50% alcohol by volume of said aqueous solution, which moistens the intermediate layer and kills microbes exposed to the sanitizing liquid and vapor arising therefrom;

d) situating the saturated intermediate layer within the mask preform;

e) adhering the inner layer to the outer layer on the remaining edges, whereby the intermediate layer, moistened with the sanitizing liquid, is enclosed in the cavity to form a mask body, the mask is prepared for use by the wearer and the sanitizing liquid and vapor in the moistened intermediate layer of the subject mask sterilize both the air inhaled by the wearer and the air exhaled by the wearer.

2. A kit for assembling a sanitizing face mask for inhibiting the transmission of pathogens in air respired through the nose and mouth of a wearer, the mask having top and bottom edges and two side edges, the kit comprising a mask preform and an intermediate layer, the mask preform comprising an inner layer, an outer layer, and securing ties, the inner layer and the outer layer having a unitary construction comprising a sheet of starting material folded over itself along a fold line, and wherein:

a) the inner layer is integral with the outer layer on at least one of the edges;

b) the inner layer is configured to be adhered to the outer layer on the remaining edges to form a cavity;

c) the intermediate layer is configured to be saturated with a sanitizing liquid and thereafter situated in the cavity between the inner and outer layers and enclosed therein to form a mask body, the sanitizing liquid comprising an aqueous solution of ethanol containing at least 50% alcohol by volume of said aqueous solution, which moistens the intermediate layer and kills microbes exposed to the sanitizing liquid and vapor arising therefrom; and d) the securing ties are configured to secure the mask with the mask body disposed across the nose and mouth of the wearer, whereby the intermediate layer, moistened with the sanitizing liquid, is enclosed in the cavity to form the mask body, and the sanitizing liquid and vapor in the moistened intermediate layer of the subject mask sterilize both the air inhaled by the wearer and the air exhaled by the wearer.

3. The kit of claim 2, wherein the mask is configured such that substantially all of the air respired by the wearer during use passes through the intermediate layer.

4. The kit of claim 2, configured such that the mask body is substantially free of any areas within the cavity that are impermeable to air flow.

5. The kit of claim 2, wherein at least 80% of the effective area of the intermediate layer is at least 80% of the active area of the mask body.

6. The kit of claim 2, wherein the inner and outer layers are configured to be adhered to each other to form the cavity by a strip of pressure sensitive adhesive disposed along the remaining edges of one or both of the inner and outer layers.

7. The kit of claim 2, wherein the outer layer is permanently attached to the inner layer on three of the edges of the mask body.

8. The kit of claim 2, wherein the intermediate layer is bonded to either the inner layer or the outer layer.

9. The kit of claim 2, wherein the sanitizing liquid exhibits biocidal activity to kill pathogens and volatility to be active and effective without deleteriously affecting the wearer.

10. The kit of claim 2, wherein the inner layer is hydrophobic, and constructed of a nonwoven polymeric web or fabric.

11. The kit of claim 2, wherein the outer layer is hydrophobic, and constructed of a nonwoven polymeric web or fabric.

12. The kit of claim 2, wherein the intermediate layer is hydrophilic, capable of absorbing and holding a sanitizing liquid, and constructed of a nonwoven polymetric material, a combination of materials, or a natural fiber.

* * * * *